United States Patent [19]

Andreasson et al.

[11] Patent Number: 4,633,832

[45] Date of Patent: Jan. 6, 1987

[54] TORQUE LIMITING ARRANGEMENT IN AN I.C. ENGINE

[75] Inventors: Bo C. Andreasson, Gothenburg; Jan O. Donnerdal, Partille; Tore A. Aronsson, Mölndal, all of Sweden

[73] Assignee: AB Electrolux, Stockholm, Sweden

[21] Appl. No.: 830,645

[22] Filed: Feb. 18, 1986

[30] Foreign Application Priority Data

Feb. 27, 1985 [SE] Sweden ..... 8500955

[51] Int. Cl.[4] ..... F02D 11/10

[52] U.S. Cl. ..... 123/335

[58] Field of Search ..... 123/335

[56] References Cited

U.S. PATENT DOCUMENTS

| | | | |
|---|---|---|---|
| 3,974,805 | 8/1976 | Kondo | 123/335 |
| 4,297,977 | 11/1981 | Boyama | 123/335 |
| 4,343,273 | 8/1982 | Kondo | 123/335 |
| 4,403,970 | 9/1983 | Dretzka | 123/335 |
| 4,459,951 | 7/1984 | Tobinaga | 123/335 |
| 4,462,356 | 7/1984 | Hirt | 123/335 |
| 4,553,517 | 11/1985 | Andreasson | 123/335 |
| 4,558,673 | 12/1985 | Mackie | 123/335 |

*Primary Examiner*—Ronald B. Cox
*Attorney, Agent, or Firm*—Alfred E. Miller

[57] ABSTRACT

In engine-powered machines (motor cutting saw, motor chain saw) with a centrifugal clutch a wearing on the clutch and belt takes place by a high load at an r.p.m. around or above the skidding r.p.m. of the centrifugal clutch. A step for reducing the said wearing can—according to the invention—be taken by limiting the driving torque of the engine in the above-said r.p.m. interval. The invention means that the cutting machine/motor saw is provided with electronic equipment counting r.p.m. and then controlling the ignition system so that the torque of the engine is lowered in a predetermined interval. In a cutting machine ignition is allowed in, for example, every third revolution within the interval 3000–6000 r.p.m. The working mode can also be widened so that the time difference between several revolutions is detected. It is then possible to indicate when the cutting machine/motor saw is in acceleration and thus refrain from reduction of the torque of the engine in order to make the machine rapidly return to a proper r.p.m. after a reduction thereof.

3 Claims, 3 Drawing Figures

TORQUE LIMITING ARRANGEMENT IN AN I.C. ENGINE

The present invention relates to an arrangement for limiting the driving torque of an internal combustion engine and is applicable preferably in engine powered hand tools, e.g. motor saws and cutting machines.

In engine-powered machines with a centrifugal clutch and belt, wear takes place on the clutch and belt at high loads in an r.p.m. range just above the engaging r.p.m. of the clutch. In cutting machines the cutting disk is also subjected to an extra wear, if it rotates too slowly during work. In chain saws the centrifugal clutch is mainly subjected to wear. The clutch will be very hot due to the wear which causes a worse function of the springs in the clutch, whereby a risk for accidents arises. A step for reducing the wear can be taken by limiting a driving torque of the engine in the said r.p.m. range.

The present invention provides an arrangement comprising an electronic circuitry which senses the r.p.m. and controls the ignition system of the engine so that the ignition of certain revolutions is missing or delayed and thus brings about a reduction of the torque. The working mode can also be widened, so that the difference in r.p.m. from one moment to another is detected whereby it is possible to indicate, whether the engine is in acceleration and thus let the arrangement refrain from reduction of the torque of the engine.

An embodiment of the invention will be described in the following paragraphs with reference to the accompanying drawings which show in FIG. 1 a simple wiring diagram of the arrangement, FIG. 2 another diagram thereof and FIG. 3 an ignition system with a microprocessor and arrangement according to FIG. 1.

Figure 1:
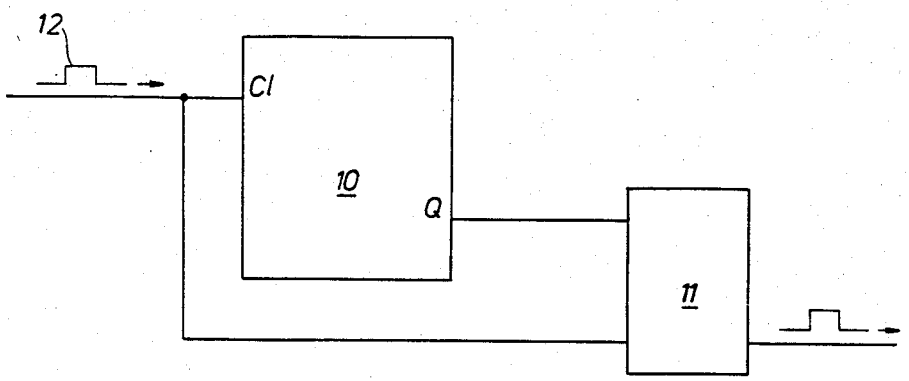
Figure 2:
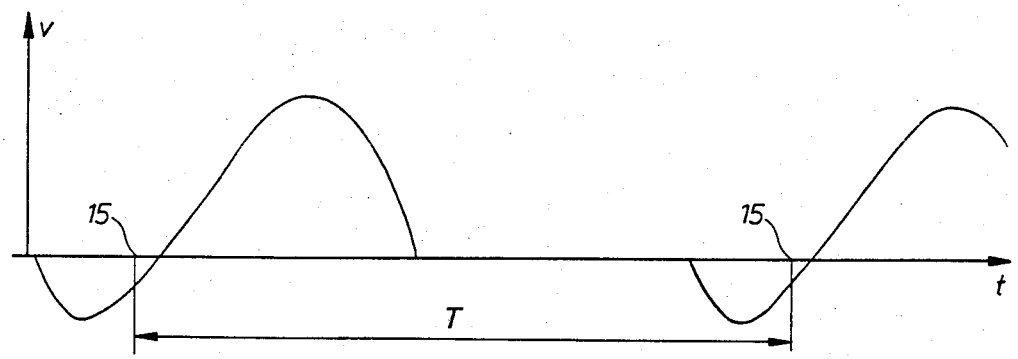

FIG. 1 shows in a block scheme how the electric connections of the arrangement may be carried out. Electric pulses from the electric system of the motor saw ignition system or the like are passed to a binary counter 10 and an AND-circuit 11. The counter can, in the simplest case, be a bistable flip-flop which counts between 0 and 1. The output of the counter thus shifts character at every new pulse 12 on the input Cl according to the following:

| Cl (pulse number) | Q |
|---|---|
| 1 | 0 |
| 2 | 1 |
| 3 | 0 |
| 4 | 1 |
| 5 | 0 |
| . | . |
| . | . |
| . | . |

The output Q is connected to a first input of the AND-circuit and the pulses 12 are fed to a second input. Every pulse 12 is sensed as 1 on this second input while the aforesaid character of Q (0, 1, 0, 1, . . . ) appears on the first one which thus has the value 1 or 0. When the input has 1, the pulse 12 is free to pass the circuit and it appears on the output 13 of the AND-circuit. When the value is 0, the puls 12 is stopped and the output is 0. The circuit is thus useful for separating every second pulse 12 and permitting the others to pass.

Figure 3:
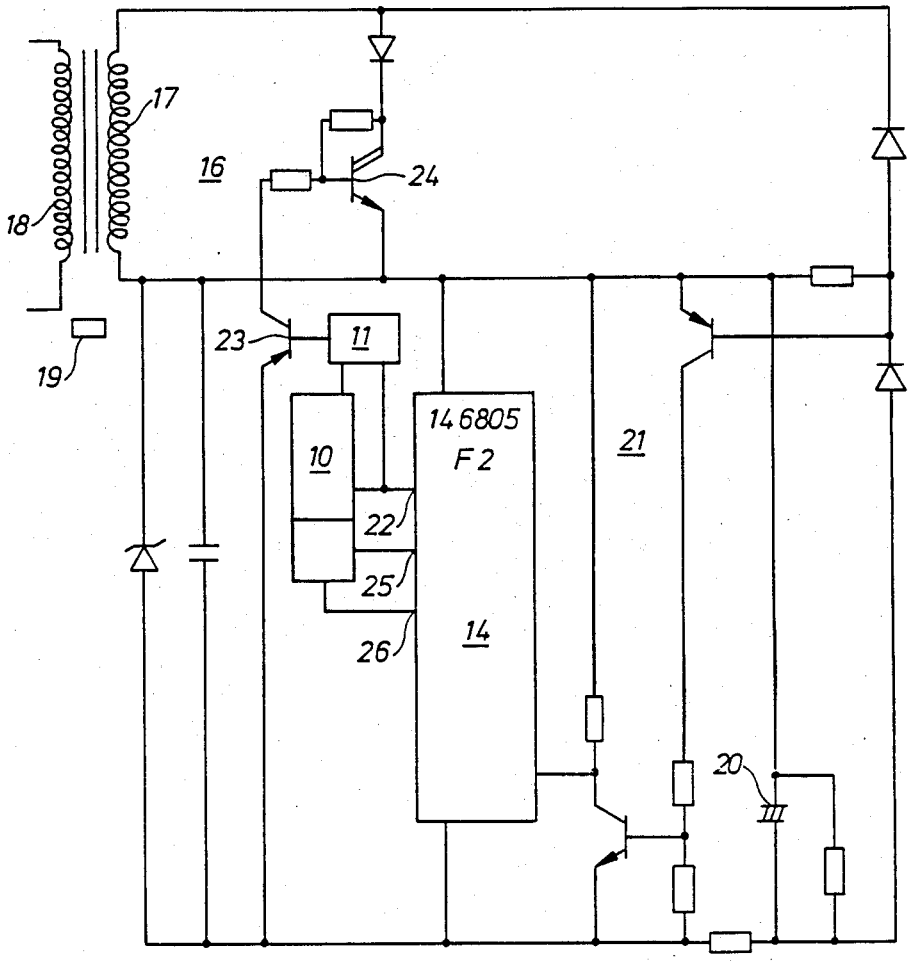

An ignition system with a triggering device comprised in a microprocessor 14 being a part of the electric system of the motor saw is envisaged schematically in FIG. 3. The processor has a timer comprised therein which by means of reference times 15 (FIG. 2) on a voltage curve generated by an ignition generator 16 measures the time of every revolution of the engine shaft. The ignition generator has, in the usual way, a couple of windings 17, 18 and a magnet 19 positioned in the flywheel. The current supply to the electronic circuits is effected by the negative half-periods of the primary voltage from the winding 17 charging a capacitor 20 to a supply voltage. A transistor amplifier 21 is used for feeding pulses at the reference time on the voltage curve, which time in this case occurs 0.6 V before the curve passes zero on its ascending part. The pulse is passed to the processor as a start signal of a procedure according to the following.

The input where the signal is supplied is scanned and the time is stored as reference time. This storing is possible since the microprocessor has a timer working on a fixed frequency. By every reference time the number of pulses passing after the preceding reference time is registered, which number of pulses corresponds to 360° of the crankshaft rotation. By dividing the number of pulses by a predetermined number, e.g. 16, a number of pulses remains which corresponds to an advanced ignition of 360/16=22.5°. This number is called the reference number and is a memory data stored in the static memory of the processor. The reference number can be dependent on the r.p.m. and is at low r.p.m. inversely proportional. When the number of timer pulses reaches the said reference number the ignition is initiated via an output 22 of the processor. The timer is set to zero every time the reference time passes and a counting to the reference number takes place for every spark. At higher r.p.m. the reference number is dependent of the r.p.m. making an ignition timing curve specific for the present kind of engine.

The arrangement in FIG. 1 is shown between the output 22 of the processor and a transistor 23 which amplifies the pulses controlling the ignition transistor 24 in the primary circuit of the ignition system. The pulses appearing on the output 22 are thus the aforesaid pulses 12 fed to the arrangement in FIG. 1. However, with regard to the presentation of the above described problems the arrangement be operative only during an r.p.m. interval where skidding and wearing shall be avoided, e.g. in the range of 3000–6000 r.p.m. This is solved by the invention in such a way that an r.p.m. depending start circuit is connected in the binary counter (flip-flop 10) when the engine reaches an r.p.m. of 3000. The start circuit is connected to an output 25 of the processor on which a signal appears at r.p.m. between 3000–6000. The signal is generated in a register which stores this r.p.m. range and is supplied by an output code from the timer of the processor which during every revolution of the engine computes a code which can be translated to the r.p.m. of the engine. The register has the property of supplying a signal, when it is receiving timer codes corresponding to 3000–6000 r.p.m.

As mentioned before the purpose of the arrangement is to restrict the driving torque of the engine in said r.p.m. interval by excluding the ignition of every second (or third, fourth etc) revolution of the engine. However, the engine would accelerate very slowly in the interval 3000–6000 r.p.m., if the arrangement always were connected and active in this interval. The start circuit of the binary counter is therefore connected to an output 26 of the processer which breaks the connection of the arrangement on acceleration of the engine. The processor emits a signal derived from the timer and the memory circuit in the same. The signal is generated by measuring of the timer of the time of revolution T which from one revolution to the next is shortened when the engine is accelerating. The condition for disconnection of the start circuit is that $$T_n - T_{n-1} < O$$

where $T_n$ is the time of revolution of the n:th revolution and $T_{n-1}$ the time of revolution of the foregoing revolution. The counting operations belong to the normal use of a processor, and as an example the indication of such a suitable processor is shown on the drawing. Finally it may be mentioned that this processor also receives and computes programmes in which now mentioned functions for excluding the ignition exist and thus the said electronic circuit exist in the processor.

We claim:

1. In a torque limiting arrangement in an internal combustion engine with a magnetic ignition system generating ignition energy and an ignition coil with a spark plug connected to its secondary winding and the primary winding connected to an ignition switch switchable by triggering, a detector giving a reference time to every ignition spark, a microprocessor having a static memory, a timer and a comparator emitting a trigger pulse via output circuits to said ignition switch, the improvement wherein the timer of the microprocessor through converting circuits emits a signal to a start circuit during an interval of r.p.m. in the middle of the total r.p.m. range of the engine and that the start circuit is connected to a logic circuit (10,11) in which the said trigger pulses in a selected succession are separated from triggering of the ignition switch with missing or delayed ignition as a consequence in said interval of the r.p.m. range of the engine.

2. Arrangement according to claim 1, wherein the logic circuit comprises at least a counter and an AND-circuit.

3. Arrangement according to claim 2, wherein a generator for a break signal in said start circuit is triggered by the timer for registering the time $T_{n-1}$ of a certain angle during a moment of the rotation of the engine and also the time $T_n$ of the same angle during another, later moment and operative circuits for computing the difference $T_n - T_{n-1}$, in which circuits a value 0 is stored as an indication on acceleration of the engine, when $T_n - T_{n-1}$ is $<\mathbf{0}$ which is the condition for the generator to give the said break signal to the start circuit.

* * * * *